US006092603A

United States Patent [19]

Lima et al.

[11] Patent Number: 6,092,603

[45] Date of Patent: Jul. 25, 2000

[54] METHOD AND EQUIPMENT FOR THE FLOW OF OFFSHORE OIL PRODUCTION WITH PRIMARY GAS SEPARATION

[75] Inventors: Paulo Cesar Ribeiro Lima, Milton Keynes, United Kingdom; Divonsir Lopes; Fernando Antonio Costa Sidrim, both of Rio de Janeiro, Brazil

[73] Assignee: Petroleo Brasileiro S.A. - Petrobras, Brazil

[21] Appl. No.: 09/117,352

[22] PCT Filed: Jan. 29, 1997

[86] PCT No.: PCT/GB97/00251

§ 371 Date: Jul. 28, 1998

§ 102(e) Date: Jul. 28, 1998

[87] PCT Pub. No.: WO97/28351

PCT Pub. Date: Aug. 7, 1997

[30] Foreign Application Priority Data

Jan. 29, 1996 [BR] Brazil ..... 19600248

[51] Int. Cl.[7] ..... E21B 33/05

[52] U.S. Cl. ..... 166/368; 166/338; 166/70

[58] Field of Search ..... 405/169–171, 405/158; 166/70, 75.15, 97.5, 372, 370, 383, 335, 338; 15/104.062; 137/368

[56] References Cited

U.S. PATENT DOCUMENTS

| | | | |
|---|---|---|---|
| 3,291,217 | 12/1966 | Wakefield | 166/75.15 |
| 3,608,631 | 9/1971 | Sizer | 166/70 |
| 4,989,671 | 2/1991 | Lamp | 166/372 X |
| 5,040,603 | 8/1991 | Baldridge | 166/70 X |
| 5,435,338 | 7/1995 | Da Silva et al. . | |
| 5,460,277 | 10/1995 | Silva . | |
| 5,478,504 | 12/1995 | de Almeida Barbuto . | |
| 5,636,693 | 6/1997 | Elmer | 166/372 X |
| 5,913,637 | 6/1999 | Rajabali et al. | 405/169 |

FOREIGN PATENT DOCUMENTS

| | | |
|---|---|---|
| 568 742 | 11/1993 | European Pat. Off. . |
| 583 912 | 2/1994 | European Pat. Off. . |
| 2 282 399 | 4/1995 | United Kingdom . |
| 9201842 | 11/1993 | WIPO . |
| 97/28351 | 8/1997 | WIPO . |

*Primary Examiner*—Dennis L. Taylor
*Attorney, Agent, or Firm*—Nixon & Vanderhye PC

[57] ABSTRACT

The invention relates to a method and equipment to assist the flow of offshore production of hydrocarbon mixtures containing a high concentration of gas. A primary separating vessel is used and production is diverted to it. This vessel is designed to allow primary separate of the gas, which flows to the gathering center via a special line. Within the primary separating vessel there is a U-shaped length of pipe whose arms are connected to two flow lines which extend to the gathering center. A mechanical interface driven by high pressure gas periodically travels along these lines, carrying with it to the gathering center the volume of liquid phase which has accumulated in the lines. If liquid phase passes into the gas flow line, a mechanical interface can be passed along this line to remove the volume of liquid which has accumulated within it.

7 Claims, 2 Drawing Sheets

PRIOR ART

METHOD AND EQUIPMENT FOR THE FLOW OF OFFSHORE OIL PRODUCTION WITH PRIMARY GAS SEPARATION

This application is the national phase of international application PCT/GB97/00251, filed Jan. 29, 1997.

FIELD OF THE INVENTION

This invention relates to a method and equipment to assist the flow, to the surface, of hydrocarbon mixtures containing a high concentration of gas. It may be applied to a single offshore oil well or to an offshore manifold which receives the output from various wells for subsequent gathering.

PRIOR ART

The growing exploration for oil in increasingly deeper waters has made it necessary for those skilled in the art to develop new techniques to increase the production of hydrocarbons from offshore wells. It is known that the mixture of hydrocarbons originating from wells can vary substantially in respect of the volumes of its phases, which are normally water, oil and gas.

Once the step of obtaining the greatest possible volume of the mixture of hydrocarbons from a well has been completed, it is then necessary to discharge the mixture to a gathering centre which has primary processing facilities. This may be an offshore platform, a vessel, or even an onshore gathering station. The mixture is discharged to the gathering centre via pipelines which may be rigid or flexible, or even a combination of both.

Very often the reservoir pressure itself is the only energy used to cause the hydrocarbon mixture to flow along these pipes to the gathering centre. However, this has a number of disadvantages because the accumulation of fluids in riser pipes causes an increase in hydrostatic pressure at the wellhead or manifold due to the formation of a column containing a significant volume of fluids. This pressure increase is undesirable because it prevents a large flow of the hydrocarbon mixture from reaching the gathering centre. In the extreme situation the reservoir pressure may be simply incapable of providing a flow to the gathering centre.

When the hydrocarbon mixture contains a large volume of gas there is always the possibility that a number of factors can come together to give rise to the phenomenon of serious intermittency, which causes great oscillations in the pressure levels of the fluid flow. A basic condition for the appearance of serious intermittency is the formation of a liquid seal in the flow lines which encourages gas segregation into the upper part of the pipes. When finally the volume of segregated gas manages in some way to pass along the rising part of the pipe which extends from the sea bed to the gathering centre (known by those skilled in the art as a "riser"), a great increase in pressure is then produced in this rising line. This sudden increase in pressure is undesirable and extremely harmful to installations.

GB-A-2282399 proposes the use of a secondary riser line which is connected to the flow line at a point located at a specific distance from the junction between the lower flow line and the main riser. This secondary riser is connected to the main riser at a point located above the junction between the main riser and the lower flow line.

The function of the auxiliary riser is to relieve the gas pressure in the flow of hydrocarbon mixture which occurs upstream from the point at which the lower flow line joins the main riser, and to inject this gas downstream from that junction point. A control valve may be fitted in the secondary riser, controlled by a sensor installed close to the connection between the flow line and the secondary riser, to control the flow of gas injected into the riser. In this way the effects resulting from the phenomenon of severe intermittency are diminished, or the phenomenon itself may even be prevented, because as the gas is injected into the main riser in a controlled way there is no sudden variation in pressure in the rising flow of fluids to the gathering centre.

This technology was a notable contribution to the control of serious intermittency in multiphase flows. However the formation, in riser pipes, of a column with a significant volume of fluids continues to cause an undesirable increase in pressure at the offshore well-head or manifold, which can even give rise to reductions in output.

OBJECT OF THE INVENTION

It is an object of this invention to propose equipment and a method which overcome the above-mentioned problems, thereby ensuring perfect or near perfect flow of the produced hydrocarbon mixture to the gathering centre.

SUMMARY OF THE INVENTION

This invention relates to a method and equipment for producing oil in a controlled way so as to avoid the accumulation of large quantities of gas, and also liquid phase, in production lines.

Accordingly one aspect of the present invention provides equipment for gathering offshore oil production, with primary gas separation, from a well head or well head manifold to a gathering centre along at least one flow line, characterized in that it comprises the use of a primary separating vessel designed to receive the output of hydrocarbon mixture originating from the well-head/manifold; in that within the primary separating vessel there is a U-shaped length of pipe whose curved part is connected to a short length of pipe which has at its lower end a first check valve; in that the two arms of the U-shaped length of pipe emerge from the primary separating vessel and connect to first and second flow lines which extend to the gathering centre; in that the primary separating vessel is designed in such a way that a primary separation of the gas contained in the hydrocarbon mixture takes place within it and segregates out the gas into the upper part of the vessel; in that a gas discharge line is connected to the upper part of the primary separating vessel in order to enable discharge of the separated gas to the gathering centre; and in that the equipment permits a mechanical interface to be passed periodically to the assembly formed by the first and second flow lines and the U-shaped pipe length within the primary separating vessel so as to promote flow to the gathering centre of the hydrocarbon mixture which has accumulated in the pipes.

A second aspect of the invention provides a method for gathering offshore oil production with primary gas separation, characterized in that it comprises the following steps:

- when the volume of hydrocarbon mixture which has accumulated in first and second flow lines from a well head or well head manifold reaches a desired level, inserting a mechanical interface into a launching device;
- then opening a gas feed valve to release pressurized gas originating from a tank into the launching device;
- driving a mechanical interface, by means of the pressurized volume of gas, to travel along one among said first and second flow lines, to pass through a first through-flow shut-off valve located at the second flow line and near a primary separating vessel and to pass along a U-shaped pipe length within the primary separating vessel and then to begin its return to a gathering centre along the first flow line thus removing to a tank a volume of hydrocarbon mixture which has accumulated in said first and second flow lines and in the U-shaped pipe length, while a check valve in a short length of piping connected in the flow lines at a point within the primary separating vessel prevents the pressurized gas from passing into the primary separating vessel;

when the mechanical interface reaches a receiving device, removing to a surge tank almost all the volume of hydrocarbon mixture which has accumulated in the first and second flow lines; and then closing the gas feed valve and opening a discharge valve at the gathering centre in order to depressurize the first and second flow lines and the U-shaped pipe length and to allow these lines to fill with hydrocarbon mixture, in order that the mechanical interface can travel along them when the volume of mixture which has accumulated within them reaches a desired level.

The mean pressure at the well-head or in the manifold is kept low, and occurrence of the phenomenon of serious intermittency is prevented, as also is the adverse effect of high pressure in the flow lines on the flow of hydrocarbon mixture to the well-head or manifold.

Production is transferred to a primary separating vessel located at some point close to the well-head or manifold. This vessel allows the effecting of a primary separation of the gas present in the hydrocarbon mixture produced. The upper part of the vessel is connected to a gas discharge line which extends to the gathering centre. Through this line there should preferably be a flow of gas.

Within the primary separating vessel there is a U-shaped pipe whose curved part is connected to a short length of pipe with a bottom valve which is designed to collect the liquid phase from the hydrocarbon mixture produced which collects at the bottom of the vessel.

The two branches of the U-shaped length of pipe emerge from inside the primary separating vessel and are connected to first and second flow lines which extend to the gathering centre. Periodically a mechanical interface is passed through the circuit formed by first and second flow lines and the U-shaped length of pipe, and is driven by means of a volume gas at high pressure. A mechanical interface removes almost all the amount of fluid which has accumulated in the first and second flow lines in the U-shaped length of pipe.

If a flow of liquid phase occurs in the gas discharge lines, an operation may be performed using the shut-off valves existing in the lines to make it possible to pass a mechanical interface also through the gas discharge line, removing to the gathering centre the liquid phase which has accumulated within that line.

BRIEF DESCRIPTION OF THE DRAWINGS

The features of this invention will be better understood from the detailed description which follows merely by way of example in association with the drawings mentioned below, which form an integral part of this description.

DETAILED DESCRIPTION OF THE INVENTION

Figure 1:
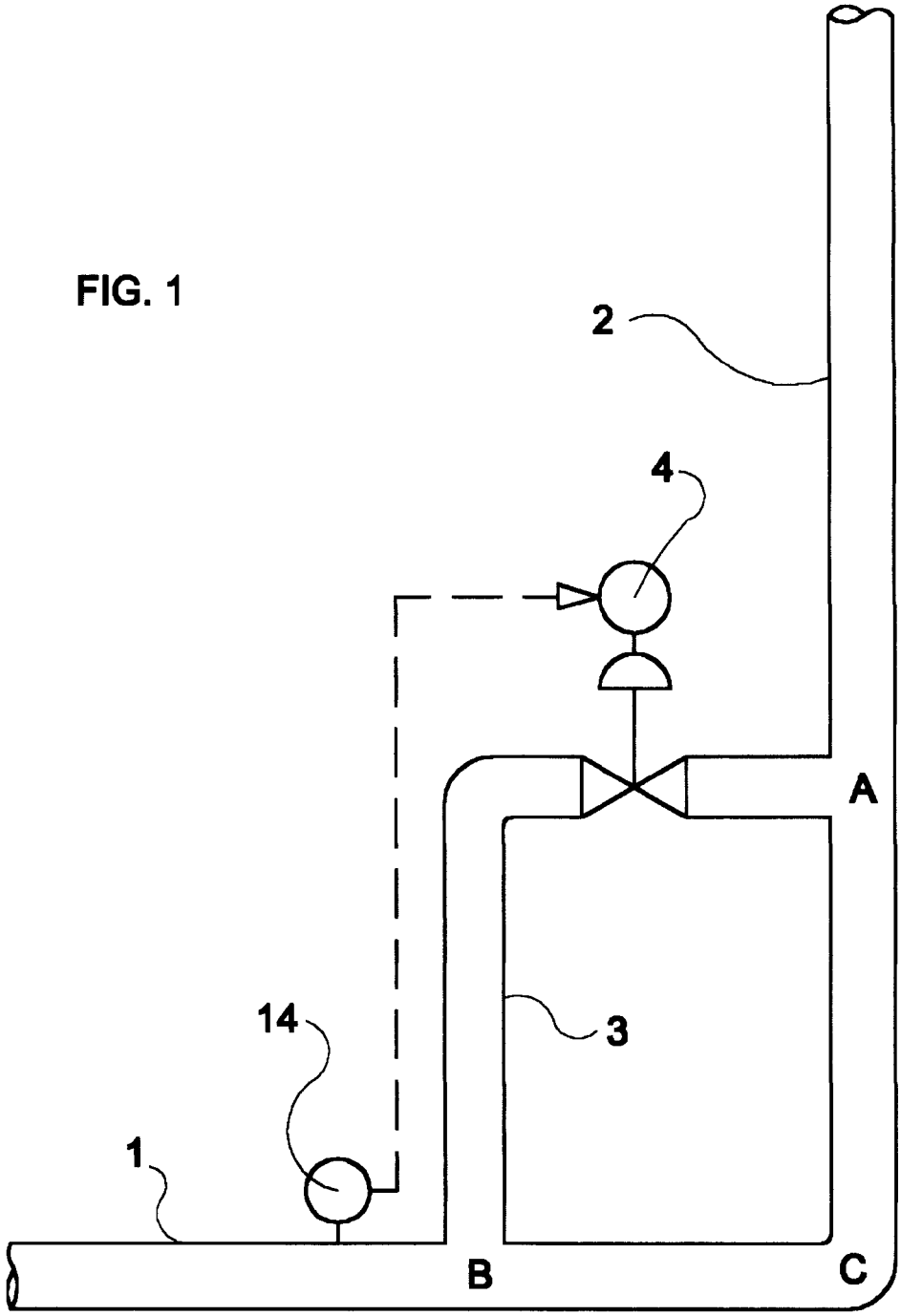
FIG. 1 is a diagrammatical illustration of application of the prior art method.

FIG. 1 shows a diagrammatical illustration of an embodiment of the prior art equipment as disclosed in the above-mentioned GB-A-2282399.

It will be seen that there is a lower flow line 1 which is connected to a main riser 2 at a particular point C. The secondary riser 3 is connected to the lower flow line 1 at point B and to the main riser 2 at point A. A pressure sensor 14 installed in the lower flow line 1 close to its intersection point B with the riser 1 controls a control valve 4 fitted in the secondary riser 3.

When the pressure at the intersection point B reaches a level which is higher than that for which pressure sensor 14 has been set, the control valve 4 is caused to operate in such a way that it maintains a controlled flow of gas between points A and B. As pressure sensor 14 perceives an increase or fall in pressure in the vicinity of point B the control valve 4 is caused to open or close proportionately, maintaining a controlled flow of gas between these two points A and B, minimizing or even eliminating the effects of serious intermittency.

Figure 2:
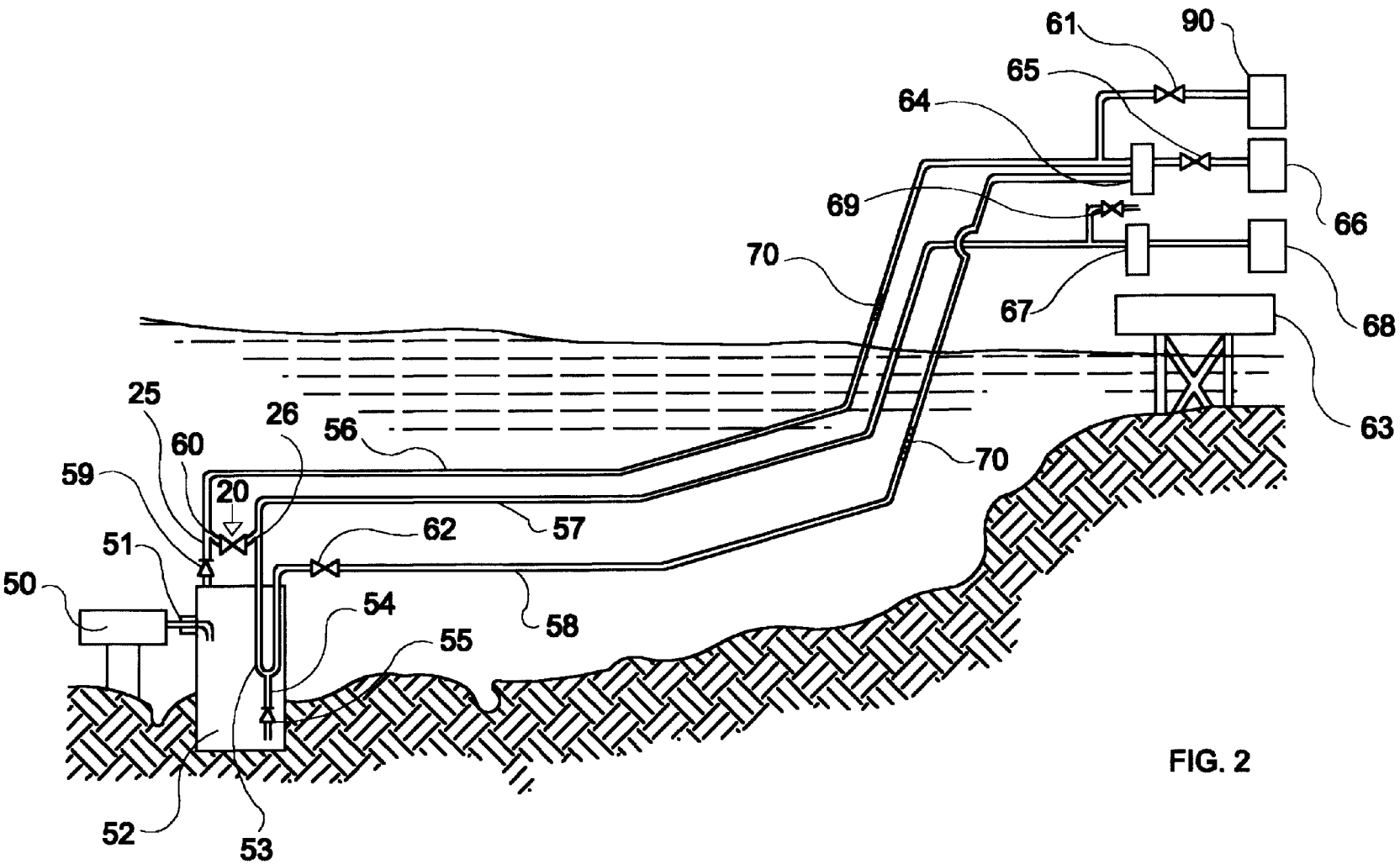
FIG. 2 is a diagrammatical illustration of application of the method and equipment according to this invention in which a primary gas separating vessel is used.

As already stated above, this technology represented a great advance in the art of controlling severe intermittency, but the problem of the back pressure exerted by the accumulation of fluids on flow lines above the wellhead or manifold continued to exist. FIG. 2 shows an embodiment of the present invention which offers a solution to the two above-mentioned problems. It will be seen that there is a unit 50, which may be a well-head or a manifold, and which for the purpose of simplification we will refer to herein as a well-head/manifold. A line 51 leads the produced hydrocarbon mixture from the well-head/manifold to a primary separating vessel 52 which has within it a U-shaped length 53 of pipe.

The lower part of this U-shaped length 53 of pipe is connected to a short length of pipe 54 which has a check valve 55 at its end. This short length of pipe 54 is responsible for collecting the fluids (normally liquids) which collect in the bottom of primary separating vessel 52 and for feeding them into the U-shaped length 53 of pipe.

The two branches of the U-shaped pipe emerge from primary separating vessel 52 and connect with first and second flow lines 57 and 58, which extend as far as a gathering centre, in this case located on a platform 63.

Primary separating vessel 52 is designed in such a way that a primary separation of the gas contained in the hydrocarbon mixture takes place within it, the gas segregating into the upper part of primary separating vessel 52. The upper part of this vessel is connected to a gas discharge line 56, through which there should preferably occur a flow of segregated gas to a gas vessel 90, which may advantageously be located at the gathering centre, as in FIG. 2. A first shut-off valve 61 can be seen close to the point where the gas discharge line 56 connects to the gas vessel 90.

In this embodiment it is suggested merely by way of illustration that the hydrocarbon mixture produced should flow to a surge tank 68 located on the platform 63 However, the gathering centre may instead be a vessel or even an onshore gathering station.

An external source of pressurized gas, illustrated in FIG. 2 by a tank 66 located on the platform 63, is responsible for supplying a volume of pressurized gas used to drive a mechanical interface 70 along lines second and first flow lines 58, 57 or gas discharge line 56 and first flow line 57, as will be described below.

A launching device 64, also located on the platform 63, is responsible for the operation of launching a mechanical interface 70 into second flow line 58 or gas discharge line 56. A gas feed valve 65 controls the supply of gas from the tank 66 to the launching device 64. A receiving device 67, also located on the platform 63, is responsible for the operation of receiving the mechanical interface 70 after it has passed along second and first flow lines 58, 57 or gas discharge line 56/first flow line 57. A gas discharge or depressurising shut-off valve 69 is responsible for depressurizing the sets of second and first flow lines 58,57 or gas discharge line 56/first flow line 57.

A first through-flow shut-off valve 62 is installed in the second flow line 58 close to the junction between the flow line 58 and one of the arms of the U-shaped length 53 of pipe which emerges from the primary separating vessel 52. This first through-flow shut-off valve 62 should normally remain open, allowing the hydrocarbon mixture to pass into the flow line 58.

A short U-shaped length 20 of pipe, located close to the primary separating vessel 52, serves as linking line to connect the gas discharge line 56 to the first flow line 57 and includes a second through-flow shut-off valve 60. It will also be noted that there is a second check valve 59 in the gas discharge line 56 close to the junction point 25 between the gas discharge line 56 and the U-shaped linking line length 20. A through-flow valve is one which will allow a mechanical interface to pass through it along the fluid path.

When the volume of hydrocarbon mixture which has accumulated in first and second flow lines 57 and 58 reaches the desired level, the procedures of the method according to this invention are then initiated:

A mechanical interface 70 is inserted in the launching device 64. The gas feed shut-off valve 65 is then opened so as to release the passage of a volume of pressurized gas from the tank 66 to the launcher device 64.

Driven by a volume of pressurized gas, the mechanical interface 70 travels along the second flow line 58, passes through the first through-flow shut-off valve 62 and through the U-shaped length 53 of pipe within primary separating vessel 52. It then begins its return to the platform 63 along the first flow line 57, thus removing the volume of hydrocarbon mixture which has accumulated in the second and first flow lines 58 and 57 and in the U-shaped length 53 of pipe. The first check valve 55 on the short length of pipe 54 prevents the volume of pressurized gas from passing into the interior of primary separating vessel 52.

When the mechanical interface 70 reaches the receiving device 67 almost all the volume of hydrocarbon mixture which accumulated in first and second flow lines will 57, 58 have been removed to the surge tank 68.

The gas feed valve 65 is then closed and the depressurizing valve 69 is then opened with the view to depressurizing the first and second flow lines 57 and 58 and the U-shaped pipe length 53, to allow these lines to fill with the mixture of hydrocarbons, so that mechanical interface 70 can again travel along them when the volume of accumulated mixture is sufficient.

As a result of the accumulation of liquid caused by a fall in the separating efficiency within the primary separating vessel 52, or for any other reason, situations may occur in which the liquid phase may pass into gas discharge line 56. This accumulation of liquid is undesirable because it prevents the gas, which has separated out in the primary separating vessel, from flowing normally to the gas vessel 90 located on the platform 63. It is then necessary to encourage removal of this liquid from the gas discharge line 56, and this is done by passing a mechanical interface 70 driven by a volume of pressurized gas.

The launching of the mechanical interface 70 into the gas discharge line 56 is started by opening the second through-flow shut-off valve 60 and closing the first through-flow shut-off valves 62 and 61. The mechanical interface 70 is then placed in the launching device 64 and the gas feed valve 65 is then opened to allow a volume of pressurized gas to pass from the tank 66 to the launcher device 64, thus driving the mechanical interface 70 along the gas discharge line 56. As the first shut-off valve 61 is closed, no high pressure gas will flow into gas tank 90.

Driven by the pressurized gas, the mechanical interface 70 travels along gas discharge line 56 and, at the point of intersection 25, passes into the U-shaped pipe length 20. The second check valve 59 prevents gas from passing into the primary separating vessel 52.

As the second through-flow shut-off valve 60 is opened, the mechanical interface 70 continues to travel within the length of U-shaped pipe length 20, through the point of intersection 26 and begins its return to the platform 63 along the first flow line 57.

When the mechanical interface 70 reaches the receiving device 67 almost all the liquid phase of hydrocarbon mixture which had accumulated in the gas discharge line 56 will have been displaced into the surge tank 68, together with any hydrocarbon mixture which might have accumulated in the first flow line 57. The gas feed valve 65 is then closed and the depressurizing valve 69 is then opened to depressurize gas discharge line 56 and first flow line 57.

Finally, first through-flow shut-off valve 62 and first shut-off valve 61 are opened and second through-flow shut-off valve 60 is closed, reestablishing normal operating conditions.

It is important to point out that the entire process of opening and closing the above-mentioned valves is remote-controlled from a location which is preferably located at the gathering centre 63. Merely for the purpose of simplifying the drawings it has been decided not to show the valve control lines. It should also be pointed out that the receiving device 67 has internal mechanisms by which a mechanical interface 70 can be removed from its interior without interrupting the flow of fluids to the surge tank 68. The launcher device 64 also has internal operating mechanisms which make it possible to choose into which lines, the gas discharge line 56 or the second flow line 58 the mechanical interface 70 is launched. The mechanisms in the receiving device 67 and the mechanisms in the launching device 64 are not described in detail in this description as they do not form an integral part of this invention and are widely known to those skilled in the art.

The launcher device 64 and the receiving device 67 may, for operating 15 convenience, be combined into a single unit which has internal mechanisms to enable the necessary operations to launch and receive mechanical interfaces to be performed. This possibility is not shown in FIG. 2 because it is also widely known to those skilled in the art and does not form part of the invention.

What is claimed is:

1. An apparatus for gathering offshore oil production, with primary gas separation, from a well head/manifold to a gathering center, comprising:

a primary separating vessel operatively coupled to said wellhead/manifold for receiving an output of hydrocarbon mixture from said wellhead/manifold;

a first, U-shaped length of pipe disposed in said primary separating vessel, said first length of pipe having a curved part and two arms;

a second, short length of pipe having a first check valve at a lower end thereof connected to said curved part of said first length of pipe;

the two arms of said first, U-shaped length of pipe being connected to first and second flow lines which extend from said primary separating vessel to a gathering center;

a gas discharge line connected to an upper part of said primary separating vessel and extending to said gathering center;

wherein a primary separation of gas contained in said hydrocarbon mixture takes place within said primary separating vessel whereby said gas is segregated out into the upper part of said primary separating vessel and is discharged through said gas discharge line to said gathering center and wherein said first and second flow lines and said first, U-shaped pipe length are constructed and arranged for a mechanical interface to periodically pass therethrough, so as to promote a flow of said hydrocarbon mixture accumulated in said first and second flow lines to said gathering center.

2. An apparatus according to claim 1, further comprising a mechanical interface launching device operatively coupled to at least one of said first and second flow lines for launching a mechanical interface thereinto, a source of high pressure gas operatively coupled to said mechanical interface launching device for driving a mechanical interface launched thereby through said first and second flow lines, a mechanical interface receiving device operatively coupled to at least one of said first and second flow lines for receiving a mechanical interface driven through said first and second flow lines, a gas vessel operatively coupled to said gas discharge line for receiving gas separated in said primary separating vessel, and discharged through said gas discharge line, and a surge tank operatively coupled to at least one of said first and second flow lines for receiving fluids caused to flow by movement of said mechanical interface through said first and second flow lines.

3. An apparatus according to claim 2, further comprising a second, U-shaped length of pipe connecting said gas discharge line to said first flow line, said mechanical interface launching device being operatively coupled to said gas discharge line for selectively launching a mechanical interface device into said gas discharge line, whereby a mechanical interface launched into said gas discharge line passes through said gas discharge line, through said second U-shaped length of pipe, and through said first flow line to said mechanical interface receiving device and wherein fluids caused to flow by movement of the mechanical interface are received in said surge tank.

4. An apparatus according to claim 1, further comprising a second U-shaped length of pipe which connects said gas discharge line to said first flow line, and first and second through-flow shut-off valves and a gas discharge valve for controlling a path of travel of said mechanical interface, to one of a first path along said second flow line, first U-shaped length of pipe and said first flow line, and a second path along said gas discharge line, said second U-shaped length of pipe and said first flow line.

5. An apparatus according to claim 4, further comprising a mechanical interface launching device operatively coupled to at least one of said first flow line, said second flow line and said gas discharge line for launching a mechanical interface thereinto, a source of high pressure gas operatively coupled to said mechanical interface launching device for driving a mechanical interface launched thereby through said flow lines, a mechanical interface receiving device operatively coupled to at least one of said first and second flow lines for receiving a mechanical interface driven through said flow lines, a gas vessel operatively coupled to said gas discharge line for receiving gas separated in said primary separating vessel, and discharged through said gas discharge line, and a surge tank operatively coupled to at least one of said first and second flow lines for receiving fluids caused to flow by movement of said mechanical interface through said first and second flow lines and said gas discharge line.

6. A method for gathering offshore oil production with primary gas separation, comprising the following steps:

providing an apparatus including:

a primary separating vessel operatively coupled to a well-head/manifold for receiving an output of hydrocarbon mixture from said well-head/manifold;

a first, U-shaped length of pipe disposed in said primary separating vessel, said first length of pipe having a curved part and two arms;

a second, short length of pipe having a first check valve at a lower end thereof connected to said curved part of said first length of pipe;

the two arms of said first, U-shaped length of pipe being connected to first and second flow lines which extend from said primary separating vessel to a gathering center;

a gas discharge line connected to an upper part of said primary separating vessel and extending to said gathering center wherein a primary separation of gas contained in said hydrocarbon mixture takes place within said primary separating vessel whereby said gas is segregated out into the upper part of said primary separating vessel and is discharged through said gas discharge line to said gathering center;

a mechanical interface launching device operatively coupled to at least one of said gas discharge line, said first flow line and second flow line for launching a mechanical interface thereinto;

a source of high pressure gas operatively coupled to said mechanical interface launching device for driving a mechanical interface launched thereby through said first and second flow lines;

a mechanical interface receiving device operatively coupled to at least one of said first and second flow lines for receiving a mechanical interface driven through said first and second flow lines;

a gas vessel operatively coupled to said gas discharge line for receiving gas separated in said primary separating vessel, and discharged through said gas discharge line; and a surge tank operatively coupled to at least one of said first and second flow lines for receiving fluids caused to flow by movement of said mechanical interface through said first and second flow lines;

inserting a mechanical interface into said mechanical interface launching device when a volume of hydrocarbon mixture accumulated in said first and second flow line reaches a desired level;

opening a gas feed valve to release a volume of gas from said source of high pressure gas into said launching device thereby to launch said mechanical interface and drive said mechanical interface to travel along said second flow line, pass through a first through-flow shut-off valve, pass along said first U-shaped pipe length within said primary separating vessel, and return to the gathering center along said first flow line thereby, to remove to said surge tank at said gathering center a volume of hydrocarbon mixture which had accumulated in said first and second flow lines and in said first, U-shaped pipe length while said first check valve in said second, short length of pipe prevents pressurized gas from passing into said primary separating vessel;

said mechanical interface reaching said mechanical interface receiving device upon return to said gathering center thereby removing to said surge tank substantially all of the volume of hydrocarbon which had accumulated in said first and second flow lines; and closing said gas feed valve and opening a gas discharge valve located at said gathering center to be depressurize said first and second flow lines and said U-shaped pipe length thereby to allow said first and second flow lines and said first, U-shaped pipe length to again fill with hydrocarbon mixture, whereby said process can be repeated.

7. A method according to claim 6, further comprising the steps of:

determining whether liquid phase has passed into said gas discharge line from said primary separating vessel and if liquid phase has passed into said gas discharge line:

opening a second through-flow shut-off valve located in a linking line which links said gas discharge line and said first flow line adjacent said well head/manifold and closing said first through-flow shut-off valve and a first shut-off valve, said first shut-off valve being located in an inlet to said gas vessel for receiving separated gas from said gas discharge line;

placing a mechanical interface into said launching device;

opening said gas feed valve so that a volume of gas at a high pressure can pass from said source of gas at high pressure to said launching device, while said first shut-off valve is closed to prevent high pressure gas from passing into said gas vessel; thereby to launch a mechanical interface into said gas discharge line;

driving said mechanical interface, by means of said volume of gas at a high pressure, to travel along said gas discharge line, into and through said linking line while a second check valve, located in said gas discharge line between said well head/manifold and a point where said linking line joins said gas discharge line, to prevent gas from passing into said primary separating vessel, and begin its return to said gathering center via said first flow line;

wherein when said mechanical interface reaches said mechanical interface receiving device at least a substantial portion of a liquid phase of the hydrocarbon mixture which had accumulated in said gas discharge line has thereby been displaced into said surge tank together with any hydrocarbon mixture which may have accumulated in said first flow line, closing said gas feed valve and opening said gas discharge valve to depressurize said first flow line and said gas discharge valve; and opening said first through-flow shut-off valve and said first shut-off valve and closing said second through-flow shut-off valve to re-establish prior operating conditions.

* * * * *